US009879552B2

(12) United States Patent
Brettes et al.

(10) Patent No.: US 9,879,552 B2
(45) Date of Patent: Jan. 30, 2018

(54) HYDRAULIC DEVICE FOR CHANGING THE PITCH OF A PROPELLER

(75) Inventors: Frédéric Brettes, Boissise le Roi (FR); Alain François Jean Lavie, Yerres (FR); Dominique Raulin, Saint Fargeau Ponthierry (FR)

(73) Assignee: SNECMA, Paris (FR)

( * ) Notice: Subject to any disclaimer, the term of this patent is extended or adjusted under 35 U.S.C. 154(b) by 1155 days.

(21) Appl. No.: 13/880,621

(22) PCT Filed: Sep. 30, 2011

(86) PCT No.: PCT/FR2011/052290

§ 371 (c)(1),
(2), (4) Date: Apr. 19, 2013

(87) PCT Pub. No.: WO2012/052649

PCT Pub. Date: Apr. 26, 2012

(65) Prior Publication Data

US 2013/0199167 A1 Aug. 8, 2013

(30) Foreign Application Priority Data

Oct. 21, 2010 (FR) ..... 10 58594

(51) Int. Cl.

| | |
|---|---|
| ***F01D 7/00*** | (2006.01) |
| ***F04D 29/56*** | (2006.01) |
| ***F04D 29/32*** | (2006.01) |

(52) U.S. Cl.

CPC ..... *F01D 7/00* (2013.01); *F04D 29/323* (2013.01); *F04D 29/563* (2013.01); *F05D 2220/36* (2013.01); *F05D 2260/50* (2013.01); *F05D 2260/79* (2013.01)

(58) Field of Classification Search

CPC ... F01D 7/00; F01D 7/16; F01D 7/162; F04D 27/00; F04D 27/002; F04D 29/323; F04D 29/36; F04D 29/363; F04D 29/563; F16J 1/12; F16J 1/18

See application file for complete search history.

(56) References Cited

U.S. PATENT DOCUMENTS

| | | | | |
|---|---|---|---|---|
| 4,790,701 | A * | 12/1988 | Baubles | F16B 37/045 411/107 |
| 6,692,177 | B2 | 2/2004 | Crudele et al. | |
| 2009/0238681 | A1 * | 9/2009 | Bouru | F01D 17/162 415/150 |

FOREIGN PATENT DOCUMENTS

| | | |
|---|---|---|
| EP | 1059422 | 12/2000 |
| FR | 2 928 979 | 9/2009 |
| FR | 2 937 678 | 4/2010 |

OTHER PUBLICATIONS

International Search Report as issued for PCT/FR2011/052290.

* cited by examiner

*Primary Examiner* — Gregory Anderson
*Assistant Examiner* — Cameron Corday
(74) *Attorney, Agent, or Firm* — Pillsbury Winthrop Shaw Pittman LLP

(57) ABSTRACT

A hydraulic device for changing the pitch of a propeller including a piston rod actuated by a hydraulic fluid, the piston rod including at its end a clevis mount able to provide a connection for transmitting the movements of the piston rod so as to change the pitch of at least one propeller, a thread nut held in position on the clevis of the piston rod by a fastener, the nut being able to collaborate with a threaded rod in order to provide a connection.

9 Claims, 2 Drawing Sheets

HYDRAULIC DEVICE FOR CHANGING THE PITCH OF A PROPELLER

CROSS-REFERENCE TO RELATED APPLICATIONS

This is the U.S. National Stage of PCT/FR2011/052290, filed Sep. 30, 2011, which in turn claims priority to French Patent Application No. 1058594, filed Oct. 21, 2010, the entire contents of all applications are incorporated herein by reference in their entireties.

The present invention relates to a hydraulic device of a control device for changing the pitch of a propeller.

The field of the invention is that of systems provided with a propeller, such as a wind turbine, an industrial fan, but also turbomachines and turbojets provided with a blower including a plurality of blades or vanes having variable setting angles.

In a known manner, a turbomachine comprises one or more stages of variable-setting blades which are mounted between rotor wheels of a compressor. These variable-setting blades are carried by the stator of the turbomachine and are adjustable in position around their axis to optimize the flow of the gases in the motor of the turbomachine. Thus, thanks to the variation of the setting of the blades, the performance of the motor of a turbomachine can be increased and its efficiency can be improved during all the phases of its operation, from take-off to landing.

Furthermore, this variable setting allows the speed of the propeller or of the blower to be varied so as to obtain the desired thrust, without altering that of the turbine which is generally set at its maximum continuous speed, or even, during landing, to reverse this thrust, thus replacing the conventional heavy and complex thrust reverse systems.

The control devices for varying the pitch of a propeller or of a blower are hydraulic actuators (cylinders, each driving blade roots) which obtain the necessary force to orient the blades in the desired position.

Each variable-setting blade comprises a cylindrical pivot at each of its ends, these pivots defining the rotation axis of the blade. The radially external pivot of the blade is engaged in a cylindrical duct of an external annular case which is connected by means of a connecting link to a control ring mounted around the annular case. The control ring is, itself, connected by a lever to a control shaft actuated by a hydraulic cylinder. Generally, the control shaft extends parallel to the axis of the case and can be connected to one or more rings so as to control one or more stages of blades with a single cylinder.

The rod of the hydraulic cylinder is connected to the control shaft by a radial arm integral with the control shaft, bringing about, by linear displacement of the rod of the cylinder, the rotation of each of the rings around the case. The rotation of a control ring is transmitted by the corresponding billets to the external pivots of the blades of a stage, causing them to turn around their axes.

The rod of the cylinder comprises at its end a clevis allowing a connection to be provided with a ball joint forming the end of the radial arm integral with the control shaft. The connection between the clevis and the ball joint is provided by means of a screw/nut connection.

As a function of the constraints of volume and architecture of the blower, in some cases the environment close to the hydraulic cylinder only offers the necessary volume to the nut and its motion during the functioning of the hydraulic cylinder. This volume is consequently not sufficient to be able to install, position or else correctly retain the nut during the mounting or dismantling operations of the hydraulic cylinder, for example during maintenance operations.

Thus, during the handling operations of the hydraulic cylinder, the operator needs to dismantle various adjacent parts so as to free a sufficiently large space so that the operator can access the nut of the screw/nut connection and thus be able to manipulate it and dismantle it easily.

In this context, the invention aims to solve the problems mentioned above, by proposing a hydraulic device for changing the pitch of blades enabling a rapid mounting and/or dismantling of the device to be ensured, for example during a maintenance operation, whilst being free from the dismantling of other adjacent parts.

To this end, the invention proposes a hydraulic device for changing the pitch of a propeller comprising a piston rod actuated by a hydraulic fluid, the said piston rod comprising at its end a clevis able to provide a connection for transmitting the movements of the said piston rod so as to change the pitch of at least one propeller, the said hydraulic device being characterized in that it comprises a threaded nut held in position on the said clevis of the said piston rod by retaining means, the said nut being able to collaborate with a threaded rod to provide a connection.

Owing to the invention, the dismantling of the hydraulic cylinder, for example during a handling operation, is realized rapidly by simple unscrewing of the threaded rod, enabling the loosening of the hydraulic cylinder from the control shaft. The dismantling of the cylinder is realized without dismantling other adjacent parts, despite a complex architecture which does not allow access to the tightening nut of the screw/nut connection.

The hydraulic device for changing the pitch of a propeller according to the invention can also present one or more of the characteristics below, considered individually or according to all technically possible combinations:

- the said threaded nut is a self-locking nut;
- the said retaining means are formed by the cooperation of a metallic plate integral with the said threaded nut and a interface metal part integral with the said clevis, comprising elastic means able to receive and retain the said metallic plate;
- the said elastic means are formed by elastic lugs, each comprising at least one slot;
- the said metallic plate comprises protuberances able to cooperate with the said slots of the said elastic lugs by clipping or by stapling;
- the said device comprises means for blocking the rotation of the said interface metal part with respect to the said clevis;
- the said threaded nut comprises two lugs projecting radially with respect to the rotation axis of the said threaded nut, which are able to cooperate with two openings arranged in the said metallic plate;
- the said sub-assembly formed by the said metallic plate and by the said threaded nut comprises means for blocking the rotation of the said sub-assembly with respect to the said interface metal part;
- the said hydraulic device is able to change the pitch of variable-setting blades of a blower of a turbomachine.

Another object of the present invention is a control device for changing the pitch of a propeller, comprising a hydraulic device for changing the pitch according to the invention.

Other characteristics and advantages of the invention will emerge more clearly from the description which is given thereof below, by way of indication and in no way restrictive, with reference to the attached figures, in which:

In all the figures, the common elements bear the same reference numbers, unless specified otherwise.

FIG. 1 is a perspective view of a piston rod of a hydraulic device for changing the pitch of variable-setting blades according to a first example embodiment of the invention.

In a known manner, the hydraulic cylinder 100 is formed by a body 10 and by a piston rod 20 actuated by the pressure of a hydraulic fluid circulating inside the body 10 of the cylinder 100.

The piston rod 20 comprises at its free end a substantially U-shaped clevis 30, which is intended to be connected to the control shaft via a radial arm integral with the control shaft, causing, by linear displacement of the rod 20 of the cylinder, the indirect rotation of the blades of the blower.

Figure 2:
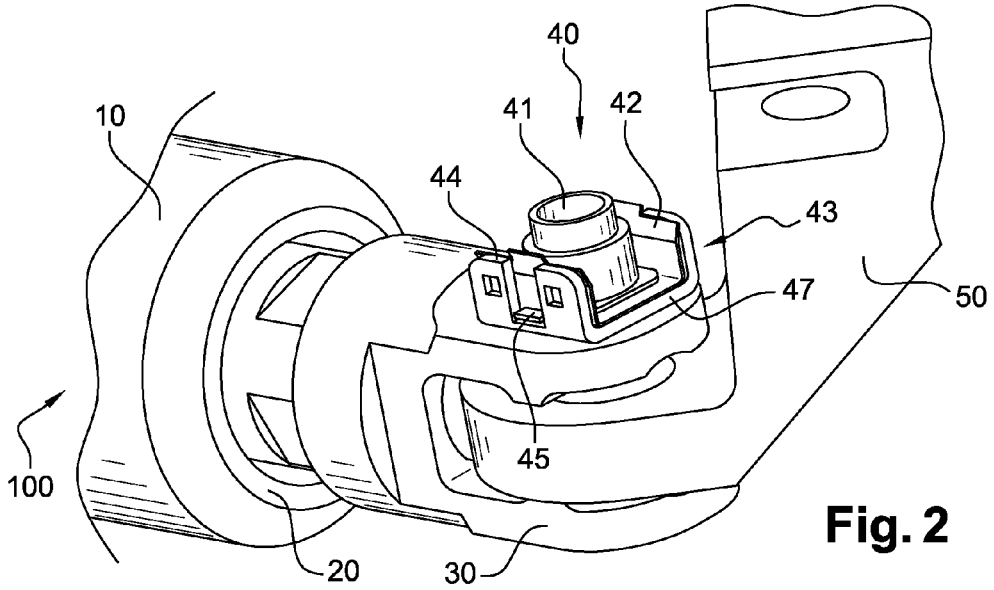
FIG. 2 is a perspective view of the piston rod illustrated in FIG. 1 integrated to a control shaft of a control device.

The clevis 30 comprises two coaxial orifices 32, passing through on either side the branches of the U of the clevis 30. The space 33 formed between the two branches of the U is intended to receive the end of a radial arm 50 of the control shaft, designated a ball joint, as illustrated in FIG. 2.

Figure 1:
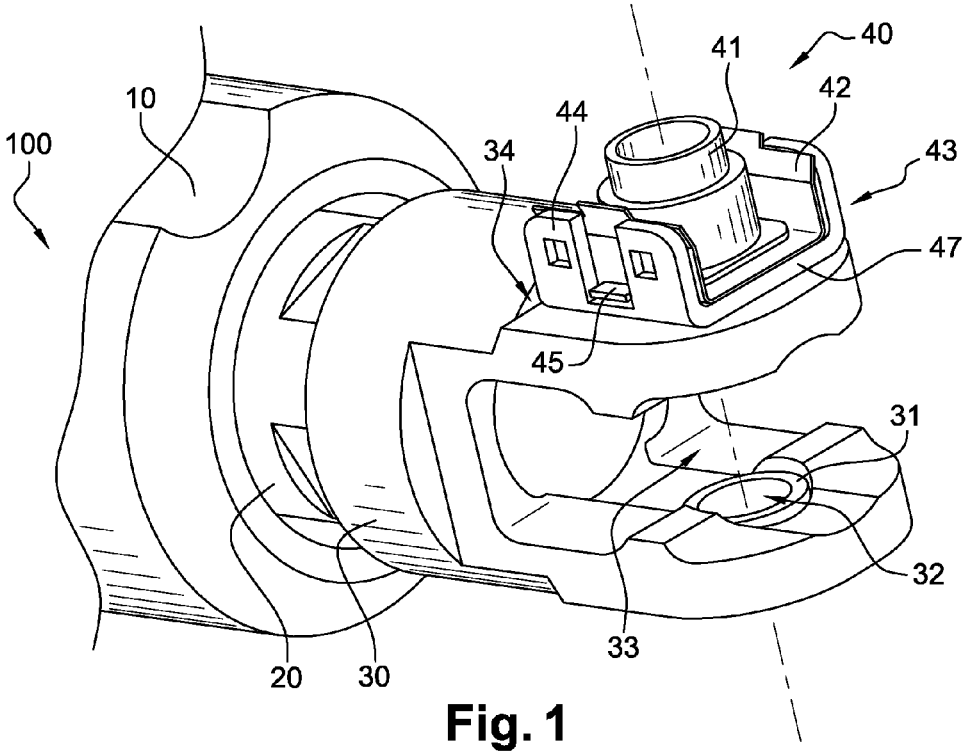
FIG. 1 is a perspective view of a rod of a hydraulic device for changing the pitch of variable-setting blades according to a first example embodiment of the invention.

On the exterior face of the upper branch of the U illustrated in FIG. 1, the clevis 30 comprises a threaded nut 41 retained in position by retaining means 40. The threaded nut is able to cooperate with a threaded rod (not represented) introduced through the orifice 32 of the lower branch of the U. Preferably, the threaded nut 41 is a self-locking nut.

The retaining means 40 are formed by:

- a metallic plate 42 formed from a metallic sheet and made integral with the threaded nut 41 by bending;
- an interface metal part 43 comprising elastic means 44 able to retain the metallic plate 42 in position by stapling or by clipping.

Figure 3:
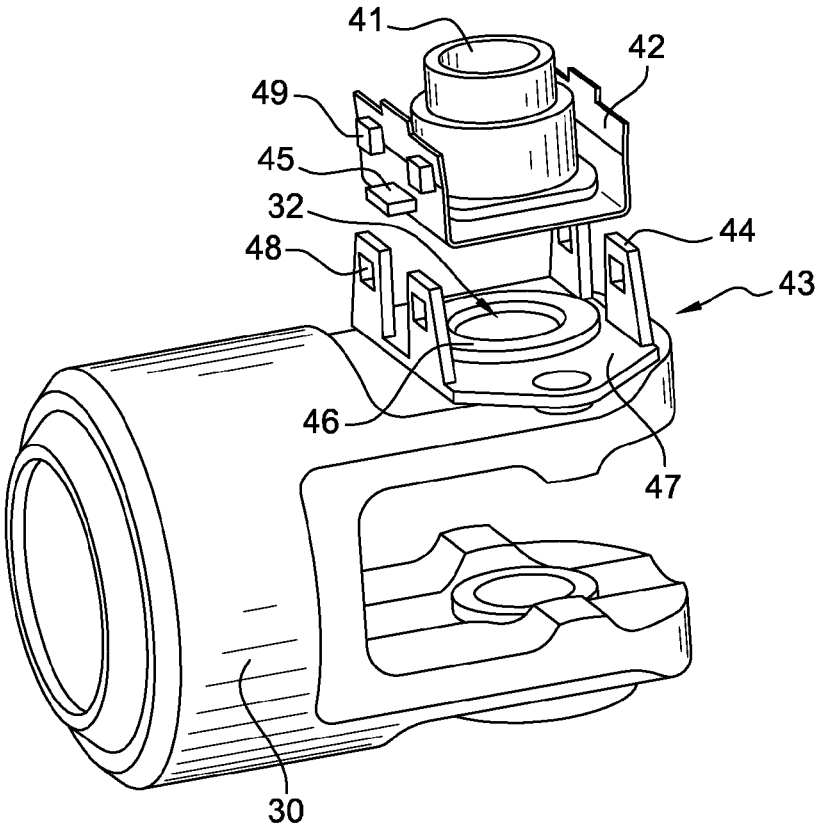
FIG. 3 is an exploded view of a captive nut integrated on the piston rod illustrated in FIG. 1.

As illustrated in FIG. 3, the interface metal part 43 has a substantially perpendicular base 47 comprising an orifice able to receive a crimping ring 46. The elastic means 44 are arranged projecting with respect to the base 47, and at the edge thereof, forming elastic lugs in which slots 48 are arranged so as to realize a clipping or stapling function.

The interface metal part 43 is integrated on the U-shaped clevis for example by shrink fitting of the crimping ring 46 in the orifice 32 of the upper branch of the U of the clevis 30.

According to the first embodiment of the invention illustrated in FIG. 1, the clevis comprises a face 34 serving as a support to the interface metal part 43 and thus realizing an anti-rotation function of the interface metal part 43. This support face 34 is obtained by the provision of a plane area on the clevis 30 able to form a flat support for the interface metal part 43.

The metallic plate 42 is formed from a flat metallic sheet of substantially rectangular shape comprising two openings, for example of rectangular shape and disposed in a parallel manner.

The nut 41 comprises an upper threaded part and a base on which two lugs 45 project radially with respect to the rotation axis of the nut 41, the shape of the lugs 45 being complementary to the shape of the openings of the metallic plate 42.

The metallic plate 42 is made integral with the nut 41 by bending of the lateral edges of the metallic sheet on either side of the nut and such that the projecting lugs 45 pass through the two openings of the metallic plate 42. Thus, the metallic plate 42 is integral with the movements of the threaded nut 41.

The metallic plate 42 also comprises protuberances 49 able to cooperate with the elastic lugs 44 of the interface metal part and, more precisely, with the slots 48 of the elastic lugs 44.

Thus, the sub-assembly formed by the nut 41 and the plate 42 is inserted in the interface metal part 43, integral with the clevis, until the introduction of the protuberances of the metallic plate 42 in the slots 48 of the elastic lugs 44.

The protuberances 49 of the metallic plate 42 and the corresponding slots 48 can be of different sizes and shapes from the moment at which they realize a clipping or stapling function between the plate 42 and the interface metal part 43.

Of course, the plate/nut sub-assembly can be freed from the interface metal part 43, and more particularly from the elastic lugs 44, by means of a specific tool allowing the elastic lugs 44 to be separated sufficiently to disengage the protuberances 49 from the slots 48.

Thus, the nut 41 is made captive, retained in position on the clevis 30 whilst guaranteeing a certain operating clearance between the sub-assembly and the interface metal part 43. The operating clearance thus enables the nut 41 to be placed precisely, by self-centring, as a function of the position of the threaded rod and thus to be able to realize the screwing function between the nut and the threaded rod. Indeed, the threaded rod is a calibrated rod which allows the clearances to be eliminated in the orifices 32 of the clevis 30.

To this effect, the orifice 32 of the lower branch of the U comprises a ring 31, the diameter of which is also calibrated to receive the calibrated threaded rod (not represented).

An additional anti-rotation function is provided between the plate/nut sub-assembly and the interface metal part 43 by positioning between two elastic lugs 44 of the interface metal part 43 the projecting lugs 45. Thus, the rotation of the plate/nut sub-assembly is blocked on the one hand by the elastic means and on the other hand by the spacing of the elastic lugs 44 allowing the passage of the projecting lugs 45 and forming lateral stops.

Figure 4:
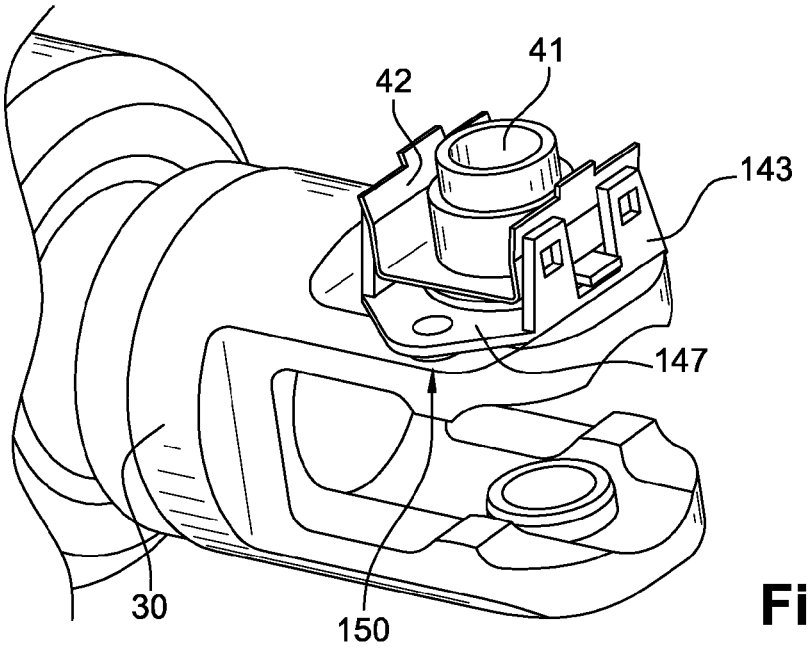
FIG. 4 is a perspective view of a piston rod of a hydraulic device for changing the pitch of variable-setting blades according to a second example embodiment.

FIG. 4 is a perspective view of a piston rod of a hydraulic device for changing the pitch of variable-setting blades according to a second example embodiment.

In this second example embodiment, the anti-rotation function of the interface metal part 143 with respect to the clevis 30 is realized by the particular geometry of the interface metal part 143.

To this effect, the interface metal part 143 comprises an excrescence of material at the level of its base 147 so as to go beyond the support face of the clevis 30. At the level of this excrescence of material, the interface metal part 143 comprises a projecting protuberance 150 directed towards the interior of the clevis 30 able to block all displacement by rotation of the interface metal part 143 with respect to the clevis 30.

The invention has been described principally for a hydraulic device for changing the pitch of variable-setting blades of a blower of a turbomachine; however, the invention is also applicable to any system provided with propellers, such as wind turbines, industrial fans or else turbojets.

The other advantages of the invention are in particular the following:

reduction of production costs;
reduction of production time;
simplification of the production process;
reduction of the costs for tools;
reduction of the material costs.

The invention claimed is:

1. A hydraulic device for changing a pitch of a propeller comprising:

a piston rod configured to be actuated by a hydraulic fluid, said piston rod comprising at its end a clevis configured to provide a connection for transmitting the movements of said piston rod so as to change the pitch of at least one propeller, and a threaded nut held in position on said clevis of said piston rod by a fastener formed by the cooperation of a metallic plate integral with said threaded nut and an interface metal part, said interface metal part being fixed to said clevis by shrink fitting of a crimping element in an orifice of the clevis, and said interface metal part comprising an elastic device configured to receive and retain said metallic plate, said nut being able to collaborate with a threaded rod in order to provide a connection.

2. The hydraulic device for changing the pitch of a propeller according to claim 1, wherein said threaded nut is a self-locking nut.

3. The hydraulic device for changing the pitch of a propeller according to claim 1, wherein said elastic device is formed by elastic lugs each comprising at least one slot.

4. The hydraulic device for changing the pitch of a propeller according to claim 3, wherein said metallic plate comprises protuberances configured to cooperate with said slots of said elastic lugs by clipping or by stapling.

5. The hydraulic device for changing the pitch of a propeller according to claim 1, comprising a blocking mechanism configured to block the rotation of said interface metal part with respect to said clevis.

6. The hydraulic device for changing the pitch of a propeller according to claim 1, wherein said threaded nut comprises two lugs projecting radially with respect to the rotation axis of said threaded nut, which are able to cooperate with two openings arranged in said metallic plate.

7. The hydraulic device for changing the pitch of a propeller according to claim 1, wherein the sub-assembly formed by said metallic plate and by said threaded nut comprises a blocking mechanism configured to block the rotation of said sub-assembly with respect to said interface metal part.

8. The hydraulic device for changing the pitch of a propeller according to claim 1, wherein said hydraulic device is able to change the pitch of variable-setting blades of the blower of a turbomachine.

9. A control device for changing the pitch of a propeller, comprising a hydraulic device according to claim 1.

* * * * *